US005586756A

United States Patent [19]

Chang

[11] Patent Number: 5,586,756

[45] Date of Patent: Dec. 24, 1996

[54] DUAL MODE PNEUMATIC SIGNATURE FEEDING SPRING AND DISABLING APPARATUS

[76] Inventor: Bobby Chang, 3100 W. Sierra Dr., Westlake Village, Calif. 91362

[21] Appl. No.: 333,286

[22] Filed: Nov. 2, 1994

[51] Int. Cl.[6] ..... B65H 5/08

[52] U.S. Cl. ..... 271/11; 271/100

[58] Field of Search ..... 271/11, 12, 99, 271/100, 107, 108, 31.1; 221/151, 153, 211

[56] References Cited

U.S. PATENT DOCUMENTS

| | | | |
|---|---|---|---|
| 4,081,945 | 4/1978 | Calvert | 271/108 |
| 4,248,417 | 2/1981 | Fujmoto | 271/11 |
| 4,938,466 | 7/1990 | Correa . | |
| 5,014,979 | 5/1991 | Higgins et al. . | |
| 5,120,041 | 6/1992 | Schniter . | |
| 5,224,694 | 7/1993 | Magee . | |
| 5,366,215 | 11/1994 | Hastie et al. | 271/100 |

*Primary Examiner*—H. Grant Skaggs
*Attorney, Agent, or Firm*—Marshall, O'Toole, Gerstein, Murray & Borun

[57] ABSTRACT

In order to increase the reliability in selectively disabling a signature feeding apparatus, and to avoid the problems which are inherent in mechanical systems, a unique dual mode pneumatic system is contemplated for use with a cyclically operable signature feeding apparatus. The feeding apparatus will generally include a driven rotary drum having a plurality of signature grippers disposed about the periphery thereof. The signature grippers are adapted to grip signatures seriatim from a signature supply hopper. A suction assembly is driven by a cam for shifting signatures seriatim from the signature supply hopper to the rotary drum for gripping by the signature grippers. The suction assembly includes oscillating suction grippers in communication with a source of vacuum. The signature feeding apparatus further includes a cam follower assembly operatively associated with the suction assembly to control movement of the oscillating suction grippers toward and away from the signature supply hopper. With this arrangement, a dual mode pneumatic system is provided having a cam follower spring mode for normally biasing the cam follower assembly toward the cam to maintain engagement therewith and a cam follower disabling mode for selectively supporting the cam follower assembly in a position out of the full path of movement of the cam to thereby disable the oscillating suction grippers.

12 Claims, 2 Drawing Sheets

DUAL MODE PNEUMATIC SIGNATURE FEEDING SPRING AND DISABLING APPARATUS

FIELD OF THE INVENTION

The present invention is generally directed to a device which is conventionally referred to as a signature feeding apparatus, and, more particularly, a signature feeding apparatus in which the suction grippers are selectively disabled by utilizing a dual mode pneumatic system.

BACKGROUND OF THE INVENTION

Many large circulation periodicals are gathered on a binding line for stitching, trimming, bundling, and shipping. The binding line typically may include a plurality of signature feeding apparatus, each of which may have a driven rotary drum with a plurality of signature grippers disposed about the periphery thereof, and the signature grippers may be adapted to grip signatures seriatim as they are received from a signature supply means after they have been shifted therefrom to the rotary drum by cam driven suction means or other like components. Conventionally, the suction means will include oscillating suction grippers, together with a vacuum control valve.

In the case of saddle stitched books, a signature feeding apparatus will open the pages of a signature so that it may be dropped onto a saddle conveyor. The saddle conveyor then conveys that signature to the next signature feeding apparatus which may, in like manner, drop still another signature in straddle relation on top of the previously so distributed signature. In this manner, a book which is comprised of an entire collection of different signatures can be gathered for stitching on the saddle conveyor.

As will be appreciated by those skilled in the art, a book is simply a collection of signatures, regardless of the number of signatures and regardless of the manner in which the book is bound.

In more recent years, the books that are gathered on a binding line have been customized and/or personalized by utilizing a variety of different techniques. Typically, this involves computer control systems whereby different combinations of signature feeding apparatus along a binding line are selectively disabled and enabled in order to customize books according to demographics or the like. As a result, there has been a need to control operation of the various signature feeding apparatus on a binding line in a manner that is entirely satisfactory.

In the past, it will be appreciated that this has sometimes been accomplished in a variety of different ways, although almost always in a less than satisfactory manner. In this connection, experience has established that a desirable manner of shifting signatures seriatim from a signature supply hopper to a rotary drum is by means of oscillating suction grippers and, thus, one manner of disabling a signature feeding apparatus has been to shut off the vacuum by mounting an air cylinder on the vacuum valve which moves a sliding member across the vacuum inlet port leading to the oscillating suction grippers. While effective to disable the apparatus, this particular technique allows the oscillating suction grippers to continue impacting the stack of signatures in the supply hopper.

While the delivery of signatures is interrupted, the continual impacting of signatures is well know as being detrimental. Specifically, it has been found that, in practice, it is sometimes the case that, after a given signature feeding apparatus has been disabled for a period of time, a resumption of the vacuum will not cause the next signature in the signature supply hopper to be delivered to the rotary drum in such a manner that it can be gripped as intended by the signature grippers thereon. If this fails to occur, a signature that is needed for a given book will not be delivered to the saddle conveyor as required.

As a result, the book that was being formed will be defective and must be discarded and reordered. It is, of course, now known how to accomplish this objective as disclosed in various commonly owned patents and patent applications of R. R. Donnelley & Sons Company, but it would be highly desirable to further reduce, if not entirely eliminate, the waste that otherwise is known to exist by reason of this problem which is encountered when utilizing conventional disablement techniques. In other words, the binding line could be rendered more efficient by eliminating this known problem area.

In the past, this has been accomplished largely by utilizing what may be considered and described as mechanical "catch" systems. These systems are well suited for locking the suction grippers in a disabled position, but, in some instances, they require replacement after a certain period of operation. For this reason, it would be highly desirable to replace a mechanical system with a system requiring at least significantly reduced maintenance.

The present invention is directed to overcoming one or more of the foregoing problems and achieving one or more of the resulting objectives.

SUMMARY OF THE INVENTION

It is an object of the present invention to provide an improved signature feeding apparatus which eliminates waste while enhancing operating efficiency in a bindery. Further, it is an object of the present invention to provide a signature feeding apparatus having an improved manner of selectively disabling the oscillating suction grippers that requires very low maintenance. In addition, it is an object of the present invention to provide a pneumatic system having dual modes of operation to alternately serve as a spring and a disabling mechanism.

Accordingly, the present invention is directed to a cyclically operable signature feeding apparatus including a driven rotary drum having a plurality of signature grippers disposed about the periphery thereof. The signature grippers are adapted to grip signatures seriatim from a signature supply means. The signature feeding apparatus also includes suction means driven by cam means for shifting signatures seriatim from the signature supply means to the rotary drum for gripping by the signature grippers. The suction means includes one or more oscillating suction grippers in communication with a source of vacuum. With this arrangement, the cyclically operable signature feeding apparatus will be understood to further utilize an entirely unique cam follower transfer arm (lever) assembly and dual mode pneumatic means as will be described in greater detail hereinafter.

As for the cam follower transfer arm (lever) assembly, it is operatively associated with the suction means to control movement of the oscillating suction grippers toward and away from the signature supply means. The pneumatic means has dual modes of operation including a cam follower spring operating mode and a cam follower disabling operating mode. In the spring operating mode, the pneumatic means normally biases the cam follower transfer arm (lever)

assembly toward the cam means to maintain engagement of the cam follower transfer arm (lever) assembly with the cam means.

On the other hand, when the pneumatic means is in the cam follower disabling mode of operation, it selectively supports the cam follower transfer arm (lever) assembly in a position out of the full path of movement of the cam means to thereby selectively disable the oscillating suction grippers.

In the exemplary embodiment, the cam means will be understood to include a cam surface defining a high dwell region and a low dwell region, both of which are normally in driving engagement with the cam follower transfer arm (lever) assembly. More specifically, the cam follower transfer arm (lever) assembly advantageously includes a transfer arm having a cam follower for engagement with a cam surface of the cam means for the purpose of imparting oscillating movement thereto. In this connection, the transfer arm normally is biased by the pneumatic means toward the cam means for engagement of the cam follower with the cam surface about an axis which is located remote from an axis of the cam means.

However, in the cam follower disabling mode of operation, the pneumatic means is adapted to selectively disable the oscillating suction grippers. This is achieved by supporting the cam follower transfer arm (lever) assembly such that the cam follower is in a position at least outwardly from the axis of the cam means as far as the high dwell region thereof. In this manner, the pneumatic means achieves the objective of selectively disabling the oscillating suction grippers in the disabling mode of operation.

Still more specifically, the pneumatic means advantageously includes a source of pressurized air in communication with a pneumatic cylinder having a piston dividing the cylinder into both a spring chamber and a disabling chamber where only one of the two chambers is pressurized at any point in time. A valve is preferably provided intermediate the source of pressurized air and both the spring chamber and the disabling chamber, together with control means for the valve for selectively pressurizing either one and purging the other of the chambers. In particular, the control means preferably operates in such manner as to cause the valve to allow pressurized air from the source to be delivered to the spring chamber and purged from the disabling chamber in the spring mode of operation and to allow pressurized air to be delivered to the disabling chamber and purged from the spring chamber in the disabling mode of operation.

In a highly preferred embodiment of the present invention, the signature feeding apparatus includes means for mounting one end of the pneumatic cylinder in a fixed position relative to the transfer arm of the cam follower transfer arm (lever) assembly. Also, a rod is preferably integral with the piston and extends from the other end of the cylinder (opposite the mounting) to be interconnected with the transfer arm generally intermediate the cam follower and the axis about which the cam follower moves. Still further, the transfer arm is preferably operatively associated with the oscillating suction grippers through at least one oscillating movement imparting link extending generally between the oscillating suction grippers and the transfer arm.

As for other details of the present invention, the oscillating movement imparting link also advantageously extends from the oscillating suction grippers to a point generally intermediate the cam follower and the axis about which the cam follower moves.

Other objects, advantages and features of the present invention will become apparent from a consideration of the following specification taken in conjunction with the accompanying drawings.

DETAILED DESCRIPTION OF THE PREFERRED EMBODIMENT

Figure 1:
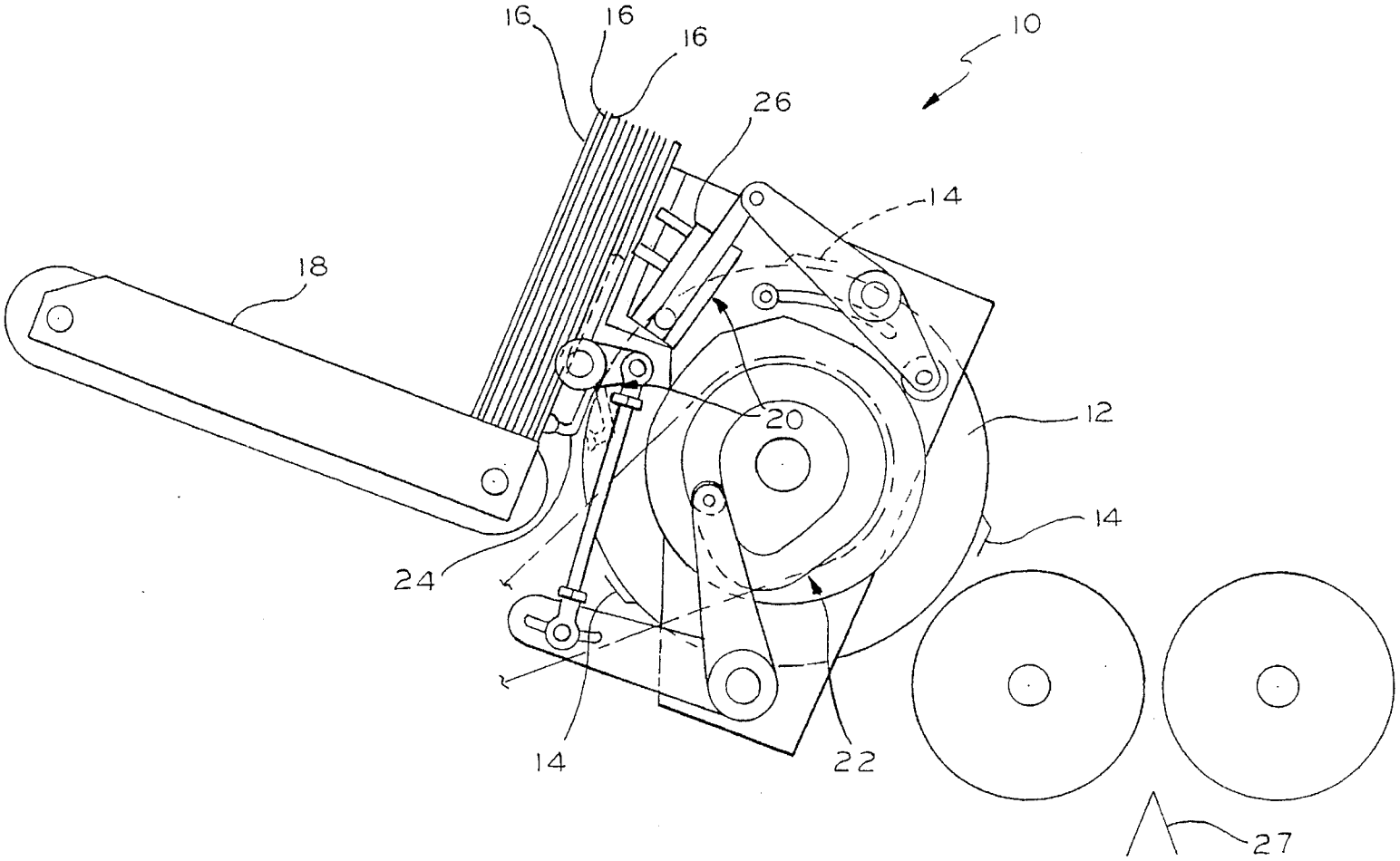
FIG. 1 (PRIOR ART)
FIG. 1 is a schematic side elevational view of a prior art signature feeding apparatus.

In the illustrations given, and with reference first to FIG. 1, the reference numeral 10 designates generally a cyclically operable signature feeding apparatus including a driven rotary drum 12 having a plurality of signature grippers 14 disposed about the periphery thereof. The signature grippers 14 are adapted to grip signatures 16 seriatim from a signature supply means 18. The signature feeding apparatus 10 also includes suction means generally designated 20 driven by cam means generally designated 22 for shifting signatures 16 seriatim from the signature supply means 18 to the rotary drum 12 for gripping by the signature grippers 14. The suction means 20 includes oscillating suction grippers 24 together with a vacuum control valve 26. With this arrangement as shown and described, the signature feeding apparatus 10 will be understood as operable in such manner as to move signatures such as 16 in a cyclical manner from a source of signatures to a gathering chain 27 on a binding line in a bindery.

Figure 2:
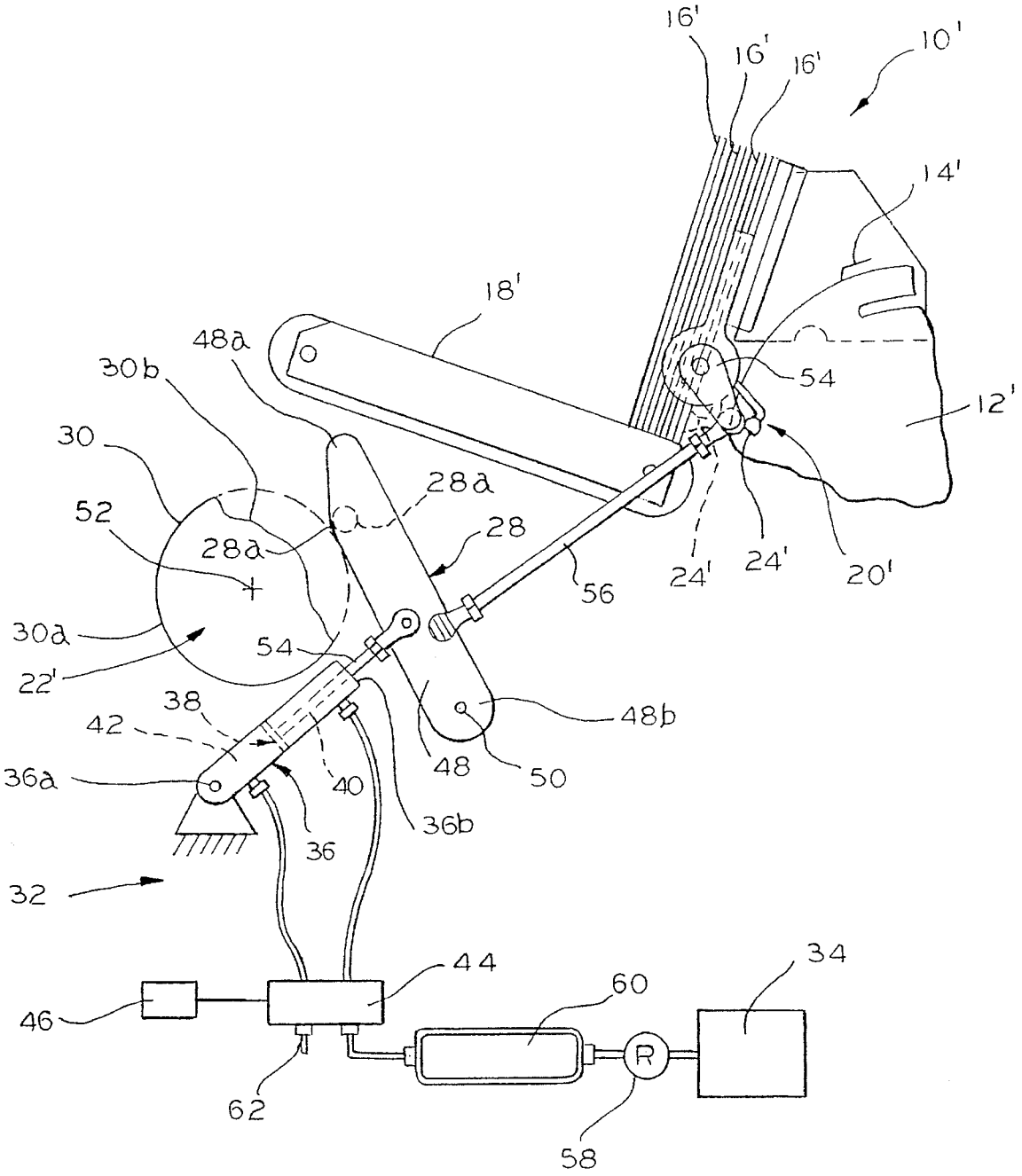
FIG. 2 is a schematic side elevational view of a signature feeding apparatus according to the invention.

With this understanding of the signature feeding apparatus 10, as known in the art, the present invention can be understood by referring to FIG. 2, where it will be seen that it is directed to a cyclically operable signature feeding apparatus generally designated 10'. The signature feeding apparatus 10' includes a driven rotary drum 12' having a plurality of signature grippers such as 14' adapted to grip signatures such as 16' seriatim from a signature supply means 18', and suction means generally designated 20' including oscillating suction grippers 24' together with a vacuum control valve (not shown) are also provided. As will further be appreciated from FIG. 2, the signature feeding apparatus 10' also includes cam means 22' for driving the suction means 24' to shift signature 16' seriatim from the signature supply means 18' to the rotary drum 12' for gripping by the signature grippers 14'.

Still referring to FIG. 2, the signature feeding apparatus 10' includes a cam follower transfer arm (lever) assembly 28 operatively associated with the suction means 20' to control movement of the oscillating suction grippers 24' toward and away from the signature supply means 18'. The cam means 22' includes a cam surface 30 defining a high dwell region **30*a* and a low dwell region 30*b*, both of which are normally disposed in driving engagement with the cam follower transfer arm (lever) assembly 28. As will be appreciated, the cam follower transfer arm (lever) assembly 28 comprises a transfer arm having a cam follower 28*a* on a roller or the like supported by the transfer arm which is normally in engagement with the cam surface 30 of the cam means 22'** for imparting oscillating movement thereto.

As also shown in FIG. 2, the signature feeding apparatus 10' includes pneumatic means generally designated 32 having dual modes of operation including a cam follower spring mode and a cam follower disabling mode. The cam follower spring mode of operation causes the cam follower transfer arm (lever) assembly 28 to normally be biased toward the cam means 22' to maintain engagement therewith, i.e., with the cam surface 30 including the high dwell region 30*a* and the low dwell region 30*b*, and the cam follower disabling mode of operation serves to selectively support the cam follower transfer arm (lever) assembly 28 in a position out of the full path of movement of the cam means 22' to thereby disable the oscillating suction grippers 24'. More specifically, the pneumatic means 32 is adapted to selectively disable the oscillating suction grippers 24' by supporting the cam follower transfer arm (lever) assembly 28 in a position at least outwardly as far as the high dwell region 30*a* of the cam means 22'.

With regard to the pneumatic means 32, it will be seen to include a source of pressurized air as schematically illustrated at 34 which is in communication with a pneumatic cylinder generally designated 36. The pneumatic cylinder 36 has a piston 38 dividing the cylinder 36 into both a spring chamber 40 and a disabling chamber 42, and a valve 44 is provided intermediate the source of pressurized air 34 and both the spring chamber 40 and the disabling chamber 42. Still additionally, the pneumatic means 32 will be understood to include control means 46 for the valve 44 in order to be able to selectively pressurize either one and purge the other of the chambers 40 and 42.

With this arrangement, the cam follower transfer arm (lever) assembly 28 will be understood to include a transfer arm 48 having the cam follower 28*a* on a roller generally adjacent one end 48*a* thereof for engagement with the cam surface 30 of the cam means 22' for imparting oscillating movement to the transfer arm. The transfer arm 48 is normally biased by the pneumatic means 32 in such manner as to urge the cam follower 28*a* toward engagement, i.e., to maintain the cam follower 28*a* in engagement, with the high and low dwell regions 30*a* and 30*b* of the cam surface 30 about an axis 50 located at the end 48*b* of the transfer arm 48 which is remote from an axis 52 of the cam means 22'. As will be appreciated, the control means 46 accomplishes this by causing the valve 44 to allow pressurized air to be delivered to and maintained in the spring chamber 40 and purged from the disabling chamber 42 in the spring mode of operation.

In the disabling mode of operation, the control means 46 operates in such manner as to cause the valve 44 to allow pressurized air to be delivered to and maintained in the disabling chamber 42 and purged from the spring chamber 40 to thereby disable the oscillating suction grippers 24'. It will be understood that this is accomplished, as previously suggested, by moving the transfer arm 48 to a position in which the cam follower 28*a* is at least outwardly of the axis 52 of the cam means 22' as far as the high dwell region 30*a* of the cam means 22'. In this position, the transfer arm 48 does not oscillate back and forth about the axis 50 since the cam follower 28*a* does not follow the high and low dwell regions 30*a* and 30*b* of the cam surface 30 as the cam means 22' is driven; on the contrary, the transfer arm 48 is held in a fixed position.

As a result, when the control means 46 causes the valve 44 to pressurize the disabling chamber 42 and purge the spring chamber 40, the transfer arm 48 holds the oscillating suction grippers 24' in a position out of contact with the next up signature 16' at the signature supply means 18'.

Still referring to FIG. 2, the signature feeding apparatus 10' will be understood to include means for mounting one end 36*a* of the pneumatic cylinder 36 in a fixed position relative to the transfer arm 48, and a rod 54 is integral with the piston 38 and extends from the other end 36*b* of the pneumatic cylinder 36. It will be appreciated that the mounting means may take any conventional form so long as the end 36*a* of the pneumatic cylinder 36 can undergo limited pivotal movement in response to oscillating movement of the transfer arm 48. As will also be appreciated, the transfer arm 48 is operatively associated with the oscillating suction grippers 24' through at least one oscillating movement imparting link 56 extending generally between the oscillating suction grippers 24' and the transfer arm 48 substantially as shown in FIG. 2.

In this connection, the oscillating movement imparting link 56 preferably extends from the oscillating suction grippers 24' to a point generally intermediate the cam follower 28*a* and the axis 50 about which the cam follower 28*a* moves. It will also be noted that the rod 54, which is integral with the piston 38, extends from the pneumatic cylinder 36 and is interconnected with the transfer arm 48 at a point generally intermediate the cam follower 28*a* and the axis 50 about which the cam follower 28*a* moves. Furthermore, and while not specifically shown, it will be appreciated that the end 48*b* of the transfer arm 48 is mounted in a fixed position for oscillating pivotal movement about the axis 50 in the manner which has been described in greater detail hereinabove.

In the illustrated embodiment, the pneumatic means 32 may include a regulator 58 through which pressurized air passes from the source 34 into an air reservoir 60. The air reservoir 60, thus, may be maintained at a set pressure to pressurize the respective chambers 40 and 42 upon demand responsive to the control means 46. Additionally, the valve 44 may include a discharge port 62 for venting pressurized air from the respective chambers 40 and 42 when either of them is to be purged.

While in the foregoing there has been set forth a preferred embodiment of the invention, it will be appreciated that the details herein given may be varied by those skilled in the art without departing from the true spirit and scope of the appended claims.

I claim:

1. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means to said rotary drum for gripping by said signature grippers, said suction means including oscillating suction grippers in communication with a source of vacuum, the improvement comprising:

a cam follower assembly operatively associated with said suction means to control movement of said oscillating suction grippers toward and away from said signature supply means; and pneumatic means having dual modes of operation including a cam follower spring mode of operation for selectively biasing said cam follower assembly toward said cam means to maintain engagement therewith and a cam follower disabling mode of operation for selectively supporting said cam follower assembly in a position out of the full path of movement of said cam means to thereby disable said oscillating suction grippers;

said pneumatic means including a source of pressurized air in communication with a pneumatic cylinder having both a spring chamber and a disabling chamber, valve means intermediate said source of pressurized air and both said spring chamber and said disabling chamber, and control means associated with said valve means for selectively pressurizing one of said chambers and purging the other of said chambers.

2. The signature feeding apparatus of claim 1 wherein said cam means includes a cam surface defining a high dwell region and a low dwell region both of which are normally in driving engagement with said cam follower assembly, said pneumatic means being adapted to selectively disable said oscillating suction grippers by supporting said cam follower assembly in a position at least outwardly as far as said high dwell region of said cam means.

3. The signature feeding apparatus of claim 1 wherein said cam follower assembly includes a transfer arm having a cam follower for engagement with a cam surface of said cam means for imparting oscillating movement thereto, said transfer arm normally being biased by said pneumatic means to urge said cam follower toward engagement with said cam surface about an axis located remote from an axis of said cam means.

4. The signature feeding apparatus of claim 1 wherein said cam follower assembly includes a transfer arm having a cam follower for engagement with a cam surface of said cam means for imparting oscillating movement thereto, said transfer arm being operatively associated with said oscillating suction grippers by an oscillating movement imparting link extending between said oscillating suction grippers and said transfer arm.

5. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means including oscillating suction grippers in communication with a source of vacuum, the improvement comprising:

a cam follower assembly operatively associated with said suction means to control movement of said oscillating suction grippers toward and away from said signature supply means, said cam means including a cam surface defining a high dwell region and a low dwell region both of which are normally in driving engagement with said cam follower assembly, said cam follower assembly including a transfer arm having a cam follower for engagement with said cam surface of said cam means for imparting oscillating movement thereto; and pneumatic means having dual modes of operation including a cam follower spring mode of operation for selectively biasing said cam follower toward said cam means to maintain engagement therewith and a cam follower disabling mode of operation for selectively supporting said cam follower in a position out of the full path of movement of said cam means to thereby disable said oscillating suction grippers;

said pneumatic means including a source of pressurized air in communication with a pneumatic cylinder having both a spring chamber and a disabling chamber, valve means intermediate said source of pressurized air and both said spring chamber and said disabling chamber, and control means associated with said valve means for selectively pressurizing one of said chambers and purging the other of said chambers.

6. The signature feeding apparatus of claim 5 wherein said pneumatic means is adapted to selectively disable said oscillating suction grippers by supporting said cam follower at least outwardly as far as said high dwell region of said cam means, said transfer arm normally being biased by said pneumatic means in such manner as to urge said cam follower toward engagement with said high and low dwell regions of said cam surface about an axis located remote from an axis of said cam means.

7. The signature feeding apparatus of claim 5 wherein said transfer arm is operatively associated with said oscillating suction grippers through at least one oscillating movement imparting link extending generally between said oscillating suction grippers and said transfer arm.

8. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means to said rotary drum for gripping by said signature grippers, said suction means including oscillating suction grippers in communication with a source of vacuum, the improvement comprising:

a cam follower assembly operatively associated with said suction means to control movement of said oscillating suction grippers toward and away from said signature supply means, said cam means including a cam surface defining a high dwell region and a low dwell region both of which are normally in driving engagement with said cam follower assembly, said cam follower assembly including a transfer arm having a cam follower for engagement with said cam surface of said cam means for imparting oscillating movement thereto;

pneumatic means having dual modes of operation including a cam follower spring mode of operation for normally biasing said cam follower toward said cam means to maintain engagement therewith and a cam follower disabling mode of operation for selectively supporting said cam follower in a position out of the full path of movement of said cam means to thereby disable said oscillating suction grippers, said pneumatic means including a source of pressurized air in communication with a pneumatic cylinder having a piston dividing said cylinder into both a spring chamber and a disabling chamber and a valve intermediate said source of pressurized air and both said spring chamber and said disabling chamber and control means for said valve for selectively pressurizing either one and purging the other of said chambers; and means for mounting one end of said pneumatic cylinder in a fixed position relative to said transfer arm and a rod integral with said piston and extending from the other end of said cylinder, said transfer arm being operatively associated with said oscillating suction grippers through at least one oscillating movement imparting link extending generally between said oscillating suction grippers and said transfer arm.

9. The signature feeding apparatus of claim 8 wherein said pneumatic means is adapted to selectively disable said oscillating suction grippers by supporting said cam follower at least outwardly as far as said high dwell region of said cam means, said transfer arm normally being biased by said pneumatic means in such manner as to urge said cam follower toward engagement with said high and low dwell regions of said cam surface about an axis located remote from an axis of said cam means.

10. The signature feeding apparatus of claim 9 wherein said control means operates in such manner as to cause said valve to allow pressurized air from said source to be delivered to said spring chamber and purged from said disabling chamber in said spring mode of operation and said control means operates in such manner as to cause said valve to allow pressurized air to be delivered to said disabling chamber and purged from said spring chamber in said disabling mode of operation.

11. The signature feeding apparatus of claim 8 wherein said transfer arm normally is biased by said pneumatic means in such manner as to urge said cam follower toward engagement with said high and low dwell regions of said cam surface about an axis located remote from an axis of said cam means and said oscillating movement imparting link extends from said oscillating suction grippers to a point generally intermediate said cam follower and said axis of said cam follower.

12. The signature feeding apparatus of claim 11 wherein said rod extends from said pneumatic cylinder and is interconnected with said transfer arm at a point generally intermediate said cam follower and said axis of said cam follower.

* * * * *